US011408674B2

(12) United States Patent
Van Amelsvoort et al.

(10) Patent No.: US 11,408,674 B2
(45) Date of Patent: Aug. 9, 2022

(54) SYSTEM FOR TREATING AND COOLING A HYDROCARBON STREAM

(71) Applicant: SHELL OIL COMPANY, Houston, TX (US)

(72) Inventors: Johannes Marinus Van Amelsvoort, Rijswijk (NL); Roel Brandt, Rijswijk (NL); Gianluca Di Nola, Rijswijk (NL); Henrik Jan Van Der Ploeg, Yokohama (JP)

(73) Assignee: SHELL USA, INC., Houston, TX (US)

( * ) Notice: Subject to any disclaimer, the term of this patent is extended or adjusted under 35 U.S.C. 154(b) by 404 days.

(21) Appl. No.: 16/340,811

(22) PCT Filed: Oct. 11, 2017

(86) PCT No.: PCT/EP2017/075891

§ 371 (c)(1),
(2) Date: Apr. 10, 2019

(87) PCT Pub. No.: WO2018/069373

PCT Pub. Date: Apr. 19, 2018

(65) Prior Publication Data

US 2019/0264978 A1 Aug. 29, 2019

(30) Foreign Application Priority Data

Oct. 13, 2016 (EP) ..... 16193642

(51) Int. Cl.
*F25J 1/02* (2006.01)
*F25J 1/00* (2006.01)

(52) U.S. Cl.
CPC ..... *F25J 1/006* (2013.01); *F25J 1/0022* (2013.01); *F25J 1/0052* (2013.01); *F25J 1/0055* (2013.01);
(Continued)

(58) Field of Classification Search
CPC ..... F25J 1/0022; F25J 1/0052; F25J 1/0055; F25J 1/0296; F25J 2270/902;
(Continued)

(56) References Cited

U.S. PATENT DOCUMENTS 3,817,046 A * 6/1974 Aoki ..... F25J 1/0022 62/612
5,916,260 A * 6/1999 Dubar ..... F25J 1/005 62/613

(Continued)

FOREIGN PATENT DOCUMENTS

EP 0862717 A1 9/1998
FR 2828273 A1 2/2003

(Continued)

OTHER PUBLICATIONS

International Search Report and Written Opinion received for PCT Patent Application No. PCT/EP2017/075891, dated Jan. 19, 2018, 10 pages.

(Continued)

*Primary Examiner* — Brian M King
(74) *Attorney, Agent, or Firm* — Shell USA, Inc.

(57) ABSTRACT

The present invention relates to a system for treating and cooling a hydrocarbon stream, comprising—a gas treatment stage comprising a pre-cooler to cool at least part of the hydrocarbon feed against cooling water, —a first cooling stage comprising one or more first water coolers, —a second cooling stage comprising one or more second water coolers. The system comprises a cooling water unit arranged to receive a stream of cooling water and supply a first part of the stream of cooling water to a chilling unit to obtain a stream of chilled cooling water and pass the stream of
(Continued)

Figure 1:
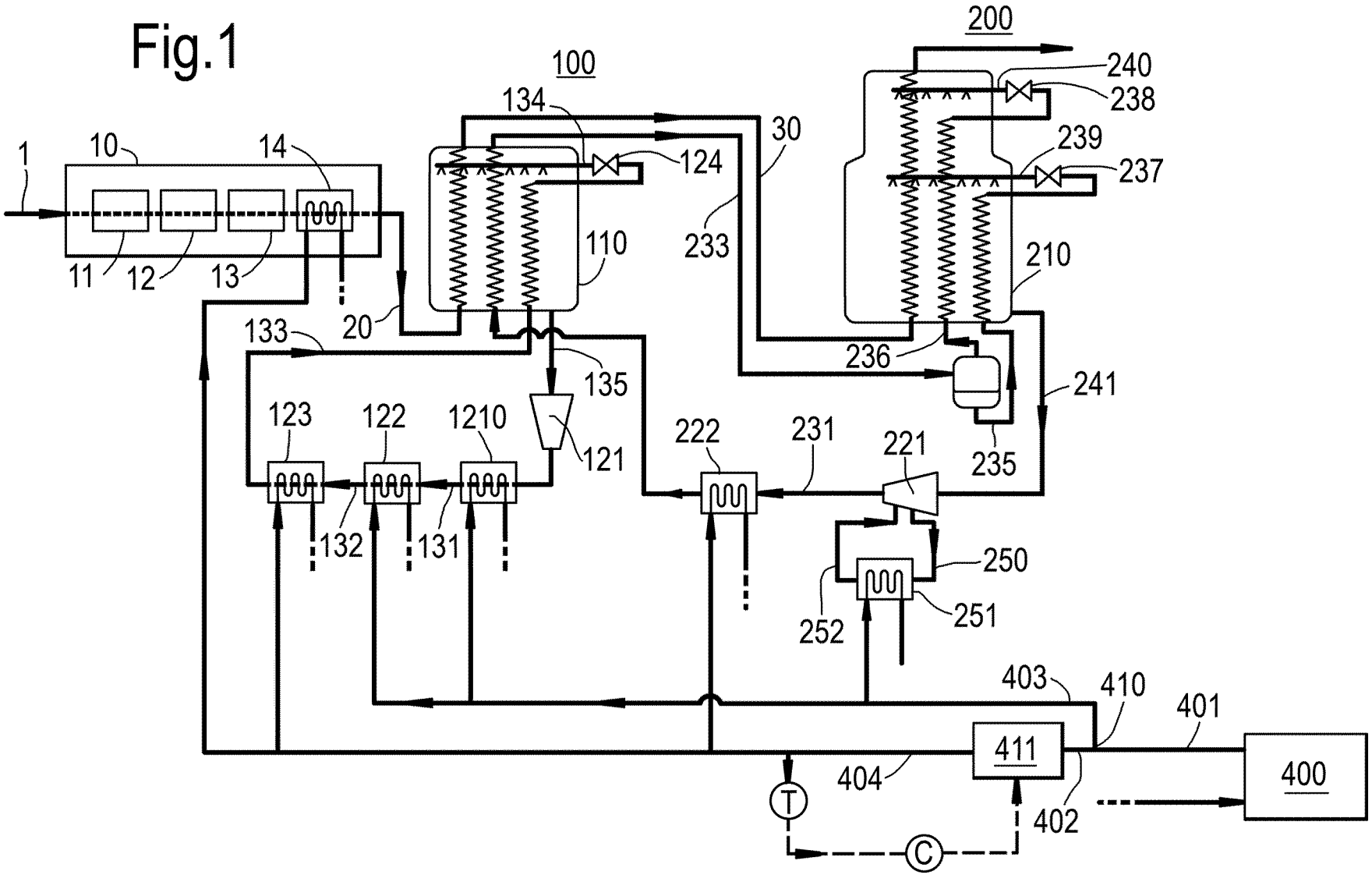

chilled cooling water to a selection of the at least one pre-cooler, the one or more first water coolers and the one or more second water coolers.

18 Claims, 4 Drawing Sheets

(52) U.S. Cl.
CPC ..... *F25J 1/0283* (2013.01); *F25J 1/0292* (2013.01); *F25J 1/0296* (2013.01); *F25J 2205/34* (2013.01); *F25J 2220/66* (2013.01); *F25J 2220/68* (2013.01); *F25J 2270/90* (2013.01); *F25J 2270/906* (2013.01)

(58) Field of Classification Search
CPC ..... F25J 2270/906; F25B 7/00; F25B 1/10; F25B 6/04; F25B 40/04; F28B 9/06
See application file for complete search history.

(56) References Cited

U.S. PATENT DOCUMENTS 8,223,495 B1 * 7/2012 Carlson ..... H05K 7/20836 361/701
2003/0033831 A1 2/2003 Davies et al.
2003/0089125 A1 * 5/2003 Fredheim ..... F25J 1/0215 62/612
2004/0011046 A1 1/2004 Pierson
2006/0162378 A1 * 7/2006 Roberts ..... F25J 1/0022 62/612
2008/0141711 A1 * 6/2008 Roberts ..... F25J 1/0218 62/611
2010/0058803 A1 * 3/2010 Ransbarger ..... F25J 1/0085 62/612
2010/0107684 A1 5/2010 Minta
2010/0175425 A1 * 7/2010 Walther ..... F25J 1/0022 62/623
2012/0090351 A1 * 4/2012 Van De Lisdonk .... F02C 7/143 62/613
2015/0253070 A1 * 9/2015 Davies ..... F25B 45/00 62/614
2015/0300732 A1 * 10/2015 Gandhi ..... F25J 1/0087 62/612
2015/0308738 A1 * 10/2015 Ott ..... F25J 3/0209 62/623
2015/0330705 A1 * 11/2015 Lee ..... F25J 1/0291 62/611
2015/0369534 A1 * 12/2015 Wang ..... F25J 1/02 62/613
2016/0061516 A1 * 3/2016 Seitter ..... F25J 1/0238 62/612

FOREIGN PATENT DOCUMENTS

FR 2957141 A1 9/2011
WO 0077466 A1 12/2000
WO 2004065869 A1 8/2004

OTHER PUBLICATIONS

Thomas et al., "Improving Energy Efficiency of LNG Plants", Total E & P—LNG Group, WGC 2009, pp. 1-12.
Bridgwood, "Improved LNG Process—Better Economics for Future Projects", LNG—The Energy Link, pp. 1-8.

* cited by examiner

SYSTEM FOR TREATING AND COOLING A HYDROCARBON STREAM

CROSS REFERENCE TO EARLIER APPLICATION

The present application is a National Stage (§ 371) application of PCT/EP2017/075891, filed Oct. 11, 2017, which claims priority benefits of European Application No. 16193642.2, filed Oct. 13, 2016, the disclosure of which is incorporated by reference herein.

TECHNICAL FIELD

The present invention relates to a method and system for treating and cooling a hydrocarbon stream using cooling water.

PRIOR ART

The throughput of a liquid natural gas producing plant (LNG plant) is predominatly determined by the mechanical shaft power for the refrigerant compressors as well as by the temperature level the heat rejection of the refrigeration cycle occurs, which is typically determined by the temperature of the ambient, such as the temperature of the water or air to which the heat is ultimately rejected.

Various solutions have been proposed for improving the throughput of a LNG plant, including solutions that apply additional chilling capacity.

U.S. Pat. No. 3,817,046 proposes to use an absorption refrigeration cycle which utilizes waste exhaust energy.

WO2004065869 proposes to use waste heat from a liquefaction step to drive chilling of either or both of a pre-treated gas stream or a refrigerant gas stream within a refrigeration cycle.

WO00/77466 describes a natural gas liquefaction system and process wherein excess refrigeration available in a typical, natural gas liquefaction system is used to cool the inlet air to gas turbines in the system to thereby improve the overall efficiency of the system.

*IMPROVED LNG PROCESS, BETTER ECONOMICS FOR FUTURE PROJECTS*, by P. Bridgewood (LNG The EnergyLink) describes that refrigeration for the cold box is principally provided by the single mixed refrigerant supplemented by ammonia refrigeration at the warm end (top) of the cold box. The ammonia refrigeration plant is powered by "free waste energy" generated by the CHP plant. The sizing of the ammonia refrigeration plant is based on the spare power available from the CHP plant after all other heat and power users in the plant have been met. This ensures optimum use and balance of all available energy. The ammonia refrigerant is firstly applied to cooling wet gas from the amine contactor, secondly applied to cooling inlet air to the gas turbines to increase power and the remainder is used in the cold box for precooling the mixed refrigerant. The result is a substantial increase in plant capacity and a substantial improvement in fuel efficiency. As an added bonus, pure water is condensed and produced when gas turbine inlet air is cooled with ammonia and this is more than enough to feed the demineralised water plant. Above can be obtained via http://www.lnglimited.com.au/IRM/Company/ShowPage.aspx?CPID=1 455&EID=56380866&.

*Improving energy efficiency of LNG plants*, by Christophe Thomas and Denis Chrétien, TOTAL E&P—LNG Group, WGC 2009 describes to provide a chilled water closed loop produced by absorption units utilising waste heat of the LNG plant, which requires complicated integration with the LNG plant. Furthermore, this article describes to pre-cool feed gas and the MR refrigerant instead of propane cooling services, which will require a lot of capacity and involves relatively difficult integration. encompasses gas turbine air inlet cooling, sub-sooling propane refrigerant and pre-cooling the feed gas and the MR refrigerant instead of propane cooling service.

SHORT SUMMARY

It is an object to provide an improved system and method for cooling a hydrocarbon stream and make it less dependent on the ambient temperature.

The present invention provides a system for treating and cooling a hydrocarbon stream, the system comprising a gas treatment stage to receive the hydrocarbon stream and treat the hydrocarbon stream to generate a treated hydrocarbon stream, wherein the gas treatment stage comprises a pre-cooler to cool at least part of the hydrocarbon feed against cooling water, a first cooling stage to receive the treated hydrocarbon stream and cool the treated hydrocarbon stream against a first refrigerant to generate a cooled hydrocarbon stream, the first cooling stage comprising one or more first water coolers to cool the first refrigerant against cooling water, a second cooling stage to receive at least part of the cooled hydrocarbon stream and cool the at least part of cooled hydrocarbon stream against a second refrigerant to generate a further cooled hydrocarbon stream, the second cooling stage comprising one or more second water coolers to cool the second refrigerant against cooling water, wherein the system comprises a cooling water unit being in fluid communication with the at least one pre-cooler, the one or more first water coolers and the one or more second water coolers, wherein the cooling water unit is arranged to receive a stream of cooling water and supply a first part of the stream of cooling water to a chilling unit to obtain a stream of chilled cooling water and pass the stream of chilled cooling water to a selection of the at least one pre-cooler, the one or more first water coolers and the one or more second water coolers, and supply a second part of the stream of cooling water to a remainder of the at least one pre-cooler, the one or more first water coolers and the one or more second water coolers.

By using a chilling unit the temperature of the cooling water can be lowered and thereby the throughput of the system can be increased. However, as a chilling unit also consumes chilling duty, the currently proposed system is adapted to only apply chilling duty on part of the stream of cooling water flowing to a dedicated selection of the water coolers.

The selection may depend on the specific circumstances, like ambient temperature, feed gas composition, availability of chilling duty, cost of chilling duty.

The second part of the stream of cooling water is not passed through (part of) the chilling unit. The second part of the stream of cooling water is passed or supplied to the remainder of the at least one pre-cooler, the one or more first water coolers and the one or more second water coolers without passing through any cooler, chiller or heat exchanger (including the chilling unit) before reaching the remainder of the at least one pre-cooler, the one or more first water coolers and the one or more second water coolers. So, the remainder of the at least one pre-cooler, the one or more first water coolers and the one or more second water coolers receive the second part of the stream of cooling water at substantially the temperature at which the stream of cooling water is received by the cooling water unit, beside any undeliberate heat exchange and/or temperature fluctuations that take place during transport, for instance caused by pumps, valves, and heat exchange through the walls of the conduits/pipes.

The system as proposed is relatively easy to implement, and could also be retrofitted to existing systems.

The chilling unit does not have significant process and/or safety implications or complexity as the flows associated with the chilling unit are of relatively moderate pressure and temperature and do not exceed normal operating pressures and temperatures of the system.

The system allows for additional cooling/chilling duty, without any complex integration with or modifications of the gas treating stage and first/second cooling stage. Neither the refrigerants nor the hydrocarbon stream are faced with additional or larger heat exchangers and there is no need for additional or larger compressors and drivers. The flow schemes of the gas treatment stage and the first and second cooling stages are not impacted.

The above described system allows for a higher throughput by lowering the achievable process temperature by selectively (i.e. to dedicated heat exchangers) adding industrial chillers and integrating them in the cooling water system.

The chilling unit does require a power source, e.g. electricity, which may be obtained from the system (e.g. from fuel gas obtained from the system), but may also be obtained from a separate source, such as from the grid. Also, a combination of these two options may be used.

According to an embodiment the chilling unit is a mechanical chiller.

The mechanical chiller comprises a refrigeration loop through which a chilling refrigerant is cycled, the refrigeration loop comprising a chilling compressor, a chilling condenser, a chilling pressure reduction device (Joule-Tompson valve) and a chilling heat exchanger in which the chilling refrigerant is warmed against the first part of the stream of cooling water. The chilling condenser may be arranged to cool the pressurized chilling refrigerant received from the chilling compressor against ambient, such as against ambient air.

The mechanical chiller, in particular the chilling compressor, is preferably electrically driven, but may also be driven by any other suitable energy source. The mechanical chiller may also be steam driven.

The chilling refrigerant may be any suitable chilling refrigerant, e.g. R-134a, NH3, LiBr.

According to an alternative the chilling unit may be an absorption chiller. Absorption chillers use a relatively hot medium, such as hot water, steam or hot oil as driver, that can be obtained from the system as waste heat. The hot oil system is used to provide heat to certain parts of the system, such as column reboilers or for regenerating dehydration gas. The temperature of the hot medium is preferably above 80° C. or above 90° C.

According to an embodiment the chilling unit is arranged to receive the first part of the stream of cooling water at a feed temperature and to chill the first part of the stream of cooling water to a chilled temperature below the feed temperature.

The chilled temperature is below the feed temperature, preferably at least 1° C. below the feed temperature, more preferably at least 2° C. below the feed temperature and even more preferably at least 4° C. below the feed temperature. For instance, the chilled temperature is 5° C. below the feed temperature.

So, the stream of chilled cooling water is colder than the second part of the stream of cooling water supplied to the remainder of the at least one pre-cooler, the one or more first water coolers and the one or more second water coolers. The stream of chilled cooling water is preferably at least 1° C. below the temperature of the chilled cooling water, more preferably at least 2° C. below the temperature of the chilled cooling water and even more preferably at least 4° C. below the temperature of the chilled cooling water. For instance, the chilled temperature is 5° C. below the temperature of the chilled cooling water.

In this way, ambient conditions typical of a cold day (winter season) or an optimum ambient temperature can be simulated resulting in flat-rating the LNG production.

According to an embodiment the chilling unit is arranged to receive the first part of the stream of cooling water at a feed temperature to chill the first part of the stream of cooling water towards but not below a predetermined temperature.

The first part of the stream of cooling water is chilled to a chilled temperature.

The chiller unit may be fully utilized to chill the first part of the stream of cooling water as much as possible as long as the chilled temperature doesn't fall below a predetermined temperature.

The gas treatment stage and the first and second cooling stage may be designed to operate optimally at a predetermined temperature of the cooling water. Typically the system is designed to function optimally with cooling water at a temperature at which the cooling water is available on average, which naturally depends on the ambient conditions. The predetermined temperature may for instance be 5° C.

This embodiment has the advantage that the throughput of the system is less dependent on variation of ambient temperature, as variations of ambient temperature results in variation of the feed temperature of the cooling water.

The system may comprise a controller to control the chilling unit depending on a measured temperature of the temperature of the first part of the stream of cooling water and/or the chilled temperature of the stream of chilled cooling water. Depending on the situation, the controller may control the chilling unit to operate

- at full capacity to chill the first part of the stream of cooling water towards the predetermined temperature as much as possible,
- at a selected intermediate capacity to chill the first part of the stream of cooling water to the predetermined temperature and prevent the chilled temperature from falling below the predetermined temperature, or
- at zero capacity (i.e. to switch off) in case the feed temperature is already at or below the predetermined temperature.

According to an embodiment the system comprises a by-pass conduit of the chiller unit for the first part of the stream of cooling water, wherein the system is arranged to pass the first part of the stream of cooling water through the by-pass in case the feed temperature is equal to or less than the predetermined temperature.

The system may in addition or alternatively be arranged to pass the first part of the stream of cooling water through the by-pass in case the chiller unit is in maintenance, thus not impacting the availability of the plant.

According to an embodiment the system is arranged to switch of the chilling unit in case the feed temperature is equal or less than the predetermined temperature.

According to this embodiment, the chilling duty consumed is minimized as the chiller can be by-passed and shed in case chilling does no longer contribute to an improved throughput.

According to an embodiment the first water coolers comprise one or more condensors, positioned downstream of a first refrigerant compressor stage arranged to receive and cool a compressed first refrigerant stream discharged by the first refrigerant compressor stage, one or more sub-coolers, positioned downstream of the one or more condensors arranged to receive and cool at least part of the first refrigerant stream discharged by the one or more condensors, the second water coolers comprise one or more after-coolers, positioned downstream of a second refrigerant compressor stage arranged to receive and cool a compressed second refrigerant stream discharged by the second refrigerant compressor stage, one or more inter-coolers being in fluid communication with the compressor stage to receive a partially compressed second refrigerant stream from the second refrigerant compressor stage and pass an intercooled second refrigerant stream to the second refrigerant compressor stage for further compression, and the selection comprises the pre-cooler, the one or more sub-coolers and the one or more after-coolers.

The selection preferably comprises all the one or more sub-coolers and all the one or more after-coolers.

In use, the condensors receive the first refrigerant in a substantially gaseous phase and discharge the first refrigerant in a substantially liquid phase.

According to an embodiment the selection further comprises the one or more inter-coolers.

The selection preferably comprises all one or more inter-coolers.

According to an embodiment the selection further comprises the one or more condensors.

The selection preferably comprises all one or more condensors.

According to an aspect there is provided a method for treating and cooling a hydrocarbon stream, the method comprising receiving the hydrocarbon stream, treating the hydrocarbon stream to generate a treated hydrocarbon stream, wherein treating comprises pre-cooling the hydrocarbon feed stream in a pre-cooler against cooling water, cooling the treated hydrocarbon stream against a first refrigerant to generate a cooled hydrocarbon stream, wherein the first refrigerant is cooled in one or more first water coolers against cooling water, further cooling at least part of the cooled hydrocarbon stream against a second refrigerant to generate a further cooled hydrocarbon stream, wherein the second refrigerant is cooled in one or more second water coolers against cooling water, wherein the method further comprises receiving a stream of cooling water, splitting the stream of cooling water in a first part and a second part, passing the first part of the stream of cooling water to a chilling unit to obtain a stream of chilled cooling water passing the stream of chilled cooling water to a selection of the at least one pre-cooler, the one or more first water coolers and the one or more second water coolers, passing the second part of the stream of cooling water to a remainder of the at least one pre-cooler, the one or more first water coolers and the one or more second water coolers.

According to an embodiment the method comprises obtaining an indication of the temperature of the stream of chilled cooling water, controlling a working duty of the chilling unit to chill the first part of the stream of cooling water towards but not below a predetermined temperature.

The chilling unit may be controlled to work at full capacity to chill the first part of the stream of cooling water towards the predetermined temperature as much as possible if the feed temperature is above a predetermined feed temperature, to work at a selected intermediate capacity to chill the first part of the stream of cooling water to the predetermined temperature in case the feed temperature is below the predetermined feed temperature but above the predetermined temperature and to work at zero capacity in case the feed temperature is already at or below the predetermined temperature.

The indication of the temperature of the stream of chilled cooling water may be obtained by doing one or more temperature measurements, not necessarily directly of the stream of chilled cooling water, but possibly also of different streams, for instance of the stream of cooling water as received.

According to an embodiment the first water coolers comprise one or more condensors, positioned downstream of a first refrigerant compressor stage arranged to receive and cool a compressed first refrigerant stream discharged by the first refrigerant compressor stage, one or more sub-coolers, positioned downstream of the one or more condensors arranged to receive and cool at least part of the first refrigerant stream discharged by the one or more condensors, the second water coolers comprise one or more after-coolers, positioned downstream of a second refrigerant compressor stage arranged to receive and cool a compressed second refrigerant stream discharged by the second refrigerant compressor stage, one or more inter-coolers being in fluid communication with the compressor stage to receive a partially compressed second refrigerant stream from the second refrigerant compressor stage and pass an intercooled second refrigerant stream to the second refrigerant compressor stage for further compression, the selection comprises the pre-cooler, the one or more sub-coolers and the one or more after-coolers.

According to an embodiment the selection further comprises the one or more inter-coolers.

According to an embodiment the selection further comprises the one or more condensors.

SHORT DESCRIPTION OF THE FIGURES

The invention will be further illustrated hereinafter, using examples and with reference to the drawing in which;

FIGS. 1, 2, 3 and 4 schematically show different embodiments.

In these figures, same reference numbers will be used to refer to same or similar parts. Furthermore, a single reference number will be used to identify a conduit or line as well as the stream conveyed by that line.

DETAILED DESCRIPTION

The embodiments provide a method and system in which a first part of the cooling water that is received is chilled to a lower temperature before being passed on to the gas treatment stage, first cooling stage and/or second cooling stage, while a second part of the cooling water is not chilled.

The cooling water is received at a feed temperature that depends on the ambient conditions.

For instance, the stream of cooling water may be received from a water tower. The water tower is arranged to cool warmed cooling water received back from the gas treatment stage, first cooling stage and/or second cooling stage against ambient, e.g. against ambient air. The resulting stream of cooling water is passed back to the gas treatment stage, first cooling stage and/or second cooling stage at a feed temperature depending on the ambient temperature, e.g. the ambient air temperature.

According to an other example, the stream of cooling water may be received from a water intake riser, in which case the feed temperature of the stream of cooling water depends on the temperature of the sea water.

By chilling a first part of the cooling water, the gas treatment stage, first cooling stage and/or second cooling stage will not be less influenced by changing ambient conditions and will be able to function in a more optimal manner.

FIG. 1 schematically depicts a system for treating and cooling a hydrocarbon stream.

FIG. 1 shows a gas treatment stage 10 arranged to receive a hydrocarbon stream 1. The gas treatment stage 10 comprises a number of gas treatment units, e.g. an acid gas removal unit 11, a dehydration unit 12, a mercury removal unit 13. The gas treatment stage 10 further comprises a pre-cooler 14 to cool at least part of the hydrocarbon feed 10 against cooling water 404 as will be described in more detail below.

The pre-cooler 14 is preferably positioned downstream (with respect to hydrocarbon stream 1) of the mercury removal unit 13 and upstream of the first cooling stage 100 (described below).

The pre-cooler 14 is shown as part of the gas treatment stage. However, it is preferably positioned directly upstream of the first heat exchanger 110 comprised by the first cooling stage 100 described in more detail below. The term directly upstream is used here to indicate that there are no further cooling, heating, separation devices in between the pre-cooler and the first heat exchanger 110. The pre-cooler 14 may also be considered to be part of the first cooling stage 100.

The gas treatment stage 10 is arranged to discharge a treated hydrocarbon stream 20.

FIG. 1 further shows a first cooling stage 100. The first cooling stage comprises a first heat exchanger 110 in which the treated hydrocarbon stream 20 is allowed to exchange heat against a first refrigerant creating a cooled hydrocarbon stream 30.

The first refrigerant may be a mixed refrigerant or may mainly comprise a single component, such as propane.

It will be understood that the first cooling stage 100 may comprise more than one first heat exchanger 110, where the more than one first heat exchangers 110 may be positioned in series and/or parallel with respect to each other. FIG. 1 only shows one for reasons of clarity.

The first cooling stage 100 further comprises a first refrigerant loop through which in use the first refrigerant is cycled. The first refrigerant loop comprises at least one first refrigerant compressor stage 121, which is depicted as comprising a single compressor. However, it will be understood that more than one compressor may be present, the more than one compressors may be arranged parallel and/or in series with respect to each other.

One or more, preferably all, of the compressors comprised by the first refrigerant compressor stage 121 may comprise watercooled desuperheaters 1210. The desuperheaters 1210 are considered part of the first refrigerant compressor stage 121.

Downstream of the first refrigerant compressor stage 121 are one or more condensors 122 arranged to receive and cool a compressed first refrigerant stream 131 discharged by the first refrigerant compressor stage 121. Downstream of the one or more condensors 122 are one or more sub-coolers 123, arranged to receive and cool at least part of the first refrigerant stream 132 discharged by the one or more condensors 122.

The condensors 122 discharge a condensed refrigerant stream 133 which is passed to an expansion device 124, optionally via the one or more first heat exchangers 100 as depicted. The expansion device 124 genates an expanded first refrigerant stream 134 which is passed to the one or more first heat exchangers 100 to cool the treated hydrocarbon stream 20. A resulting warmed first refrigerant stream 135 is collected from the one or more first heat exchangers 100 and passed back to the first refrigerant compressor stage 121.

The cooled hydrocarbon stream 30 obtained from the first cooling stage 100 is at least partially passed to the second cooling stage 200 for further cooling.

The second cooling stage 200 comprises a second heat exchanger 210 in which the cooled hydrocarbon stream 30 is allowed to exchange heat against a second refrigerant creating a further cooled hydrocarbon stream 40. This further cooled hydrocarbon stream 40 may be (partially) liquefied and passed to a further cooling stage, an end-flash unit and/or a LNG storage tank (not shown).

The second refrigerant may be a mixed refrigerant.

The second heat exchanger 210 is usually referred to aqs a main cryogenic heat exchanger. It will be understood that the second cooling stage 200 may comprise more than one second heat exchanger 210, where the more than one second heat exchangers 110 may be positioned in series and/or parallel with respect to each other. FIG. 1 only shows one for reasons of clarity.

The second cooling stage 200 further comprises a second refrigerant loop through which in use the second refrigerant is cycled. The second refrigerant loop comprises a at least one second refrigerant compressor stage 221, which is depicted as comprising a single compressor. However, it will be understood that more than one compressor may be present, the more than one compressors may be arranged parallel and/or in series with respect to each other. Downstream of the second refrigerant compressor stage 221 are one or more after-coolers 222 arranged to receive and cool a compressed second refrigerant stream 231 discharged by the second refrigerant compressor stage 221. The after-coolers 222 discharge an after-cooled second refrigerant stream 232 which is further passed to and cooled by the one or more first heat exchangers 110.

The one or more first heat exchangers 110 discharge a partially condensed second refrigerant stream 233 which is passed on to a separator 234. The separator 234 generates a light gaseous stream 235 and a heavy liquid stream 236, which are both in parallel cooled by the second heat exchanger 210 and expanded by expansion devices 237, 238 respectively. The thereby obtained expanded heavy refrigerant stream 239 and heavy refrigerant stream 240 are passed to the second heat exchangers 210 to cool the cooled hydrocarbon stream 30.

A resulting warmed second refrigerant stream 241 is collected from the one or more second heat exchangers 210 and passed back to the second refrigerant compressor stage 221.

The second cooling stage 200 may further comprise one or more intercoolers 251 being in fluid communication with the second compressor stage 221 to receive a partially compressed second refrigerant stream 250 from the second refrigerant compressor stage 221 and pass an intercooled second refrigerant stream 252 to the second refrigerant compressor stage 221 for further compression.

So, the system as described comprises

- a pre-cooler 14 being part of the gas treatment stage 10,
- one or more first water coolers being part of the first cooling stage 100, such as the one or more condensors 122 and one or more sub-coolers 123
- one or more second water coolers being part of the second cooling stage 200, such as the one or more after-coolers 222 and one or more intercoolers 251 of the second cooling stage 200, which may all be in fluid communication with a cooling water unit 400 to receive cooling water and discharge warmed cooling water back to the water unit 400 or back to the ambient.

The cooling water unit 400 may be a water tower, but may also be a water intake system, such as a water intake riser system.

The cooling water unit 400 may be arranged to provide a stream of cooling water 401 which is split in a first and second part 402, 403. It will be understood that alternative embodiments may be conceived which result in a first and second part of cooling water. Also, the first and second part of cooling water 402, 403 are not necessarily conveyed in on conduit as shown schematically, but may also be conveyed in two or more conduits in parallel.

The system comprises a chilling unit 411 which is arranged to receive the first part of the stream of cooling water 402 and discharge a stream of chilled cooling water 404.

The chilling unit 411 may be any kind of chilling unit, but preferably is a mechanical chiller, as already described above.

The chilling unit 411 is in fluid communication with a selection of the at least one pre-cooler 14, the one or more first water coolers (122, 123) and the one or more second water coolers (251, 222) to supply them with chilled cooling water, while a remainder of the at least one pre-cooler 14, the one or more first water coolers and the one or more second water coolers is fed with non-chilled cooling water.

FIG. 1 depicts an embodiment in which the selection comprises the pre-cooler 14, the one or more sub-coolers 123 and the one or more after-coolers 222 and the remainder comprises the one or more condensors 122 of the first cooling stage 100 and the one or more intercoolers 251 of the second cooling stage 200.

Figure 2:
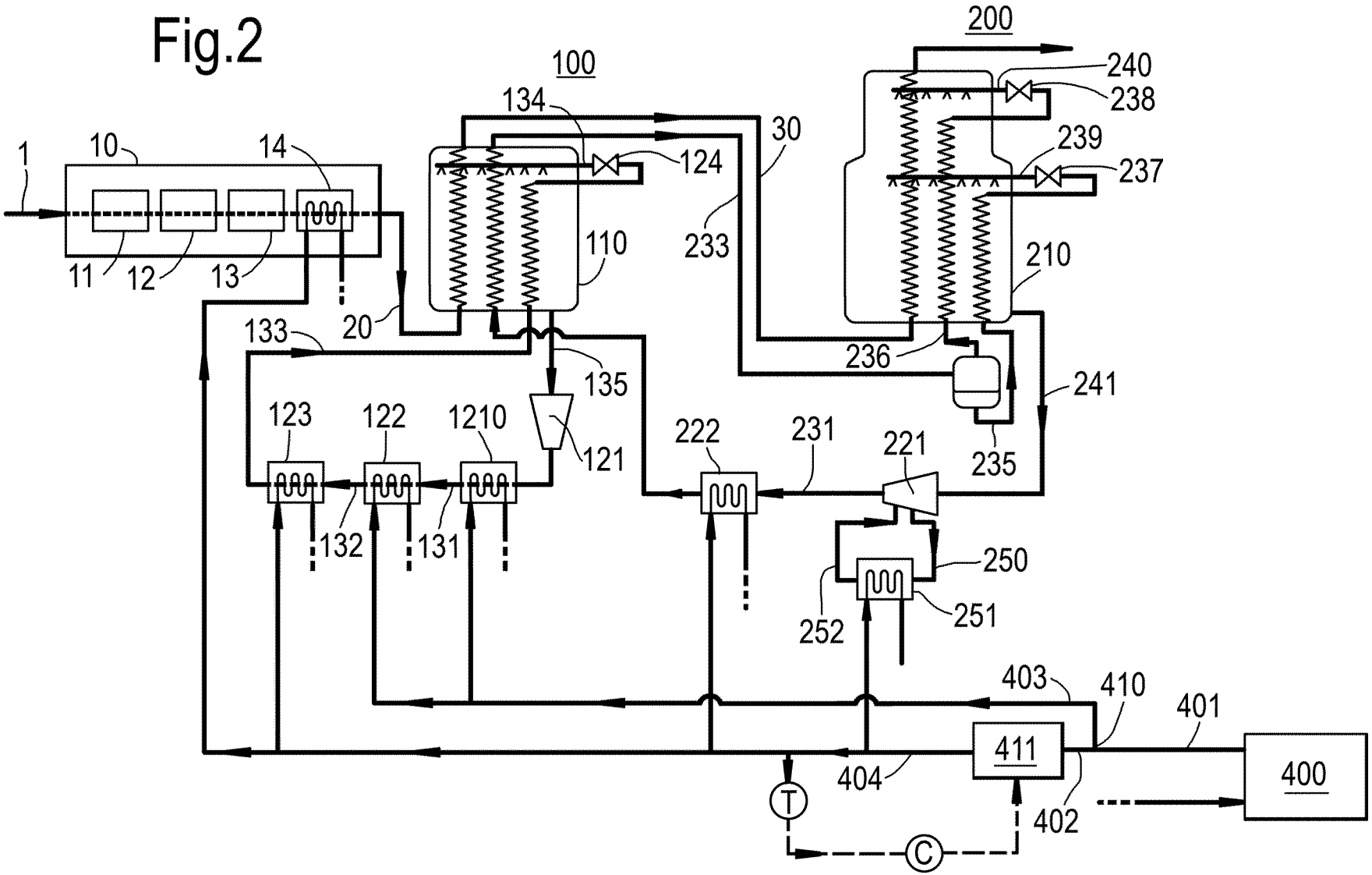

FIG. 2 depicts an embodiment in which the selection further comprises the one or more inter-coolers 251 and the remainder does not comprise the one or more inter-coolers 251 but does comprise the one or more condensors 122 of the first cooling stage 100.

Figure 3:
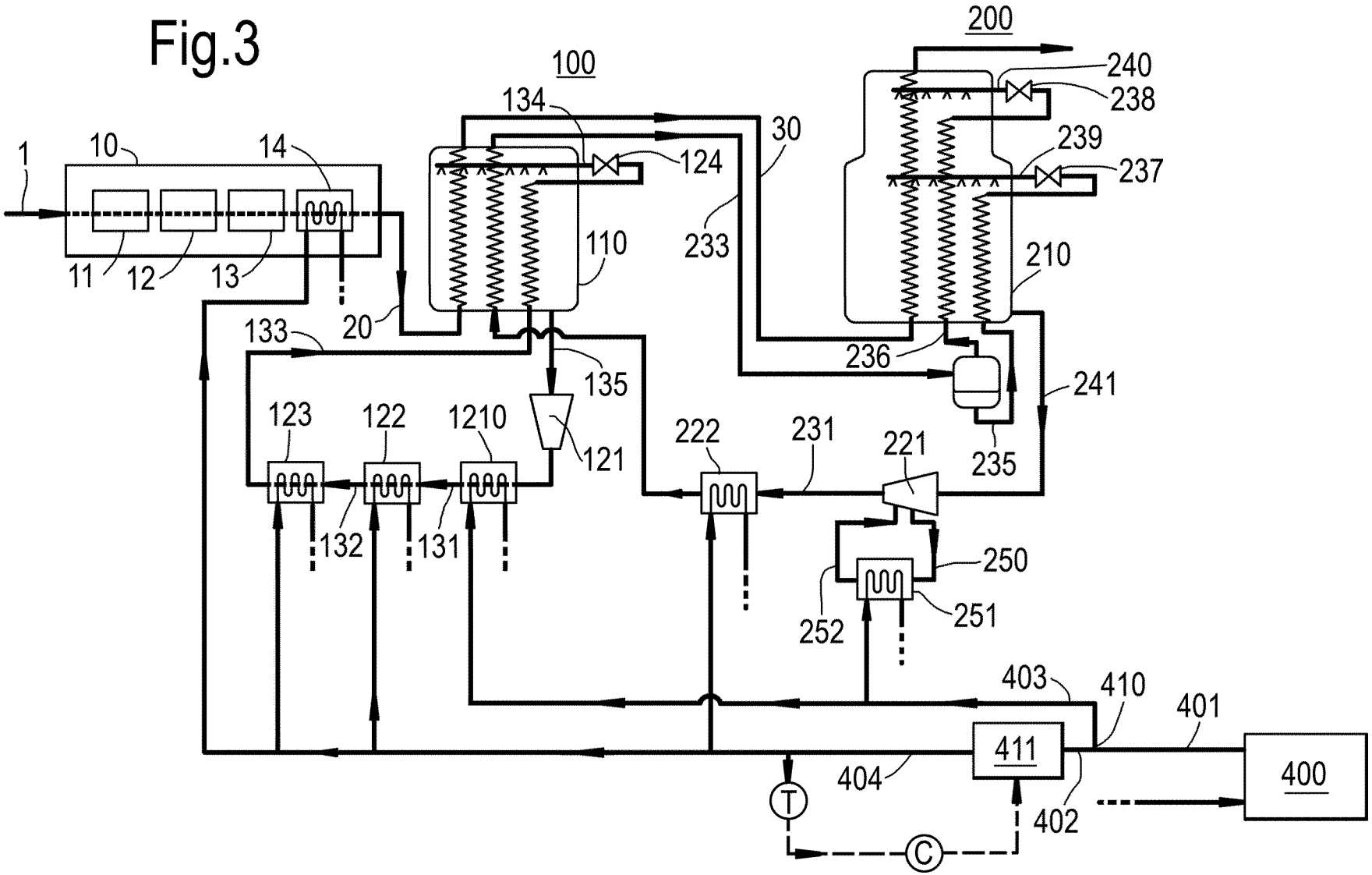

FIG. 3 depicts an embodiment in which the selection further comprises the one or more condensors 122 of the first cooling stage and the remainder does not comprise the one or more condensors 122 but does comprise the one or more inter-coolers 251 the second cooling stage 200.

Figure 4:
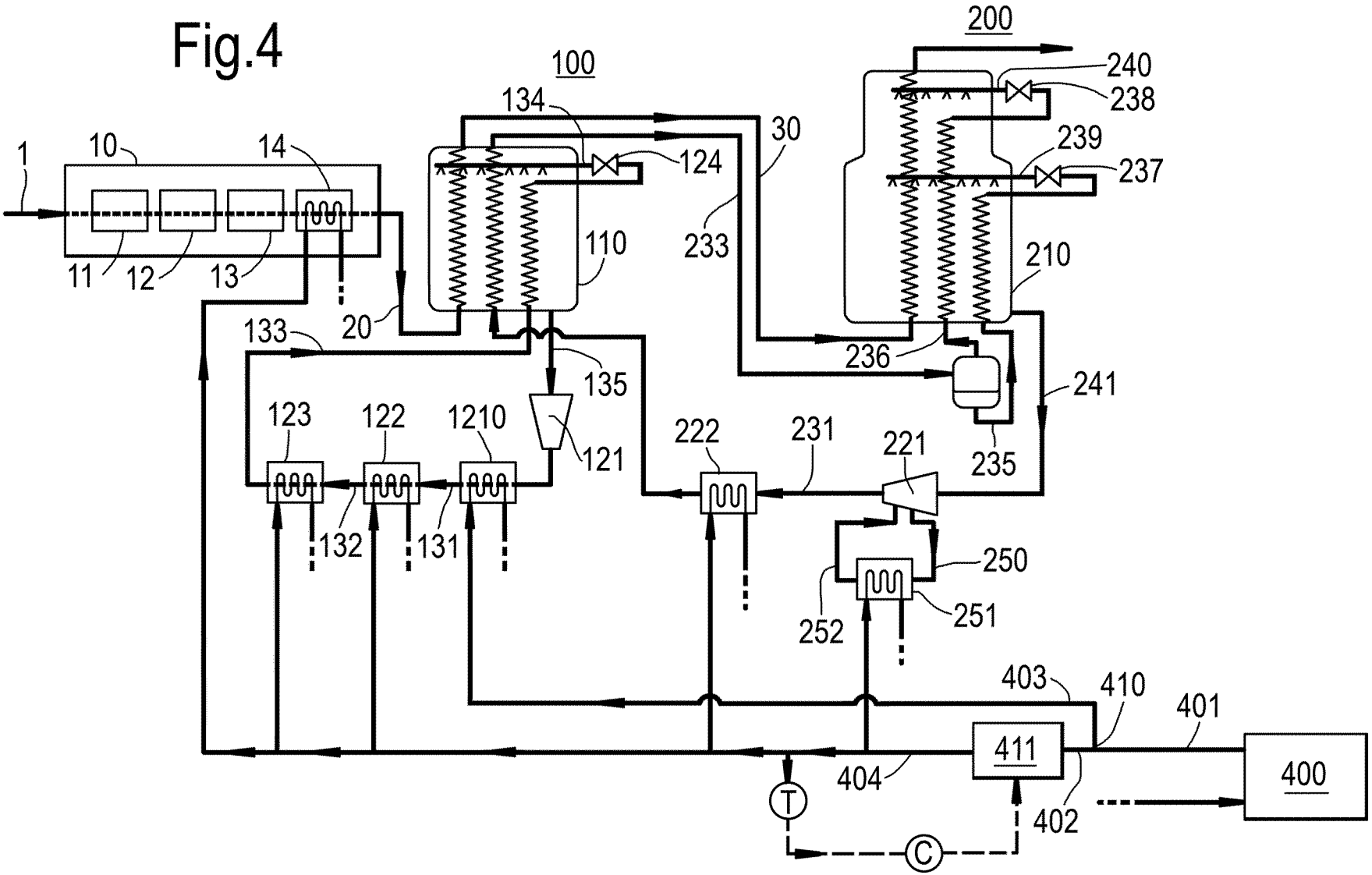

FIG. 4 depicts an embodiment in which the selection comprises the one or more condensors 122 of the first cooling stage 100 and the one or more inter-coolers 251 of the second cooling stage 200.

It will be understood that additional water cooled heat exchangers may be present.

In all embodiments shown and described, the remainder of the at least one pre-cooler 14, the one or more first water coolers and the one or more second water coolers may further comprise one or more of all additional water cooled heat exchangers that are present in the system and are not fed with chilled cooling water, such as, but not limited to

- coolers comprised by the acid gas removal unit 11, such as
  - a lean solvent cooler, comprised by acid gas removal unit 11,
  - an acid gas removal unit intercooler,
  - an acid gas removal unit condenser,
  - an acid gas removal unit flash gas cooler and
  - a flas gas compressor interstage cooler,
- a dehydration unit natural gas cooler, comprised by the dehydration unit 12,
- watercooled desuperheaters 1210 described above,
- coolers associated with the gas turbines (not shown) used to drive the first and second refrigerant compressor stages, such as
  - gas turbine(s) intercooler(s),
  - gas turbine air inlet coolers positioned in the air inlet of one or more gas turbines to cool the air being fed into the gas turbine to increase the efficiency of the gas turbine,
- condensate cooler and condensate stabilisation unit overhead compressor aftercoolers (not shown),
- various utility coolers.

It will be understood that according to a further embodiment, one or more of the above list of water cooled heat exchangers may be fed with chilled cooling water.

According to an embodiment, the gas turbine air inlet coolers are fed with chilled cooling water.

The system may comprise a controller C and a temperature measurement device T. The temperature measurement device T is arranted to obtaining an indication of the temperature of the stream of chilled cooling water 404, for instance by directly measuring the temperature of the stream of chilled cooling water 404.

The obtained indication of the temperature of the stream of chilled cooling water 404 is passed to the controller C, based on which the controller C controls the working duty of the chilling unit 411 to chill the first part of the stream of cooling water towards but not below a predetermined temperature. The controller C may control the chilling unit 411 to operate

- at full capacity,
- at a selected intermediate capacity, or
- at zero capacity (i.e. to switch off).

It will be understood that one or more separation stages may be present as part of the first cooling stage 100 or in between the first and second cooling stage 100, 200, for instance a NGL extraction stage (not shown).

It will also be understood that the gas treatment stage 10 and the first and second cooling stages 100, 200 are depicted in a schematical manner and by means of example only.

Simulations

The embodiments described above with reference to FIGS. 1-4 were simulated in ProII.

In the simulation, an average feed temperature of the cooling water was set at 10 C and the chilled temperature was set at 4° C. The heat exchangers that received the second part of the cooling water thus received cooling water at a temperature of 10° C.

The simulations showed the following results:

in the embodiment depicted in FIG. 1 approximately 13% of the cooling water was chilled resulting in a 0.6% increase of LNG production per degree C. of chilling.

in the embodiment depicted in FIG. 2 approximately 22% of the cooling water was chilled resulting in a 0.7% per degree C. of chilling increase of LNG production.

in the embodiment depicted in FIG. 3 approximately 76% of the cooling water was chilled resulting in a 0.87% per degree C. of chilling increase of LNG production.

in the embodiment depicted in FIG. 4 approximately 84% of the cooling water was chilled resulting in a 0.97% per degree C. of chilling increase of LNG production.

For comparison, also a system was simulated in which all further water cooled heat exchangers that are present in the system were also supplied with chilled water, so effectively all cooling water being chilled, resulted in a 0.97% increase of LNG production.

The embodiments depicted in FIGS. 1 and 2 require a limited amount of chilling to reach a significant production gain, whereas the embodiments depicted in FIGS. 3 and 4 require a relatively large amount of chilling for an additional incremental production gain. It was therefore discovered that a focused selection of key process heat exchangers leads to an optimum production increase within the constraints of the LNG plant.

The person skilled in the art will understand that the present invention can be carried out in many various ways without departing from the scope of the appended claims.

That which is claimed is:

1. A system for treating and cooling a hydrocarbon stream comprising:

a gas treatment stage to receive the hydrocarbon stream and treat the hydrocarbon stream to generate a treated hydrocarbon stream, wherein the gas treatment stage comprises at least one pre-cooler to cool at least part of the hydrocarbon feed;

a first cooling stage to receive the treated hydrocarbon stream and cool the treated hydrocarbon stream against a first refrigerant to generate a cooled hydrocarbon stream, the first cooling stage comprising one or more first water coolers to cool the first refrigerant;

a second cooling stage to receive at least part of the cooled hydrocarbon stream and cool at least part of the cooled hydrocarbon stream against a second refrigerant to generate a further cooled hydrocarbon stream, the second cooling stage comprising one or more second water coolers to cool the second refrigerant;

a cooling water unit being in fluid communication with the at least one pre-cooler, the one or more first water coolers and the one or more second water coolers and arranged to provide a stream of unchilled cooling water comprising a first part and a second part; and a chilling unit to receive and cool the first part of the stream of unchilled cooling water from the cooling water unit to generate a stream of chilled cooling water;

wherein the system is arranged to (i) supply the stream of chilled cooling water to a first selection of the at least one pre-cooler, the one or more first water coolers and the one or more second water coolers to cool at least a portion of the respective hydrocarbon feed, first refrigerant, or second refrigerant, and (ii) supply the second part of the stream of unchilled cooling water to a second selection of the at least one pre-cooler, the one or more first water coolers and the one or more second water coolers to cool at least a portion of the respective hydrocarbon feed, first refrigerant, or second refrigerant, wherein the at least one pre-cooler, the one or more first water coolers, and the one or more second water coolers in the second selection are not in the first selection.

2. The system according to claim 1, wherein the chilling unit is a mechanical chiller.

3. The system according to claim 1, wherein the chilling unit is arranged to receive the first part of the stream of unchilled cooling water at a feed temperature and to chill the first part of the stream of unchilled cooling water to a chilled temperature below the feed temperature.

4. The system according to claim 1, wherein the chilling unit is arranged to receive the first part of the stream of unchilled cooling water at a feed temperature to chill the first part of the stream of unchilled cooling water towards but not below a predetermined temperature.

5. The system according to claim 4, comprising a by-pass of the chiller unit for the first part of the stream of unchilled cooling water, wherein the system is arranged to pass the first part of the stream of unchilled cooling water through the by-pass in case the feed temperature is equal to or less than the predetermined temperature.

6. The system according to claim 4, wherein the system is arranged to switch off the chilling unit in case the feed temperature is equal or less than the predetermined temperature.

7. The system according to claim 1, wherein the one or more first water coolers comprise one or more condensers positioned downstream of a first refrigerant compressor stage to receive and cool a compressed first refrigerant stream discharged by the first refrigerant compressor stage, and one or more sub-coolers positioned downstream of the one or more condensers to receive and cool at least part of the first refrigerant stream discharged by the one or more condensers, wherein the one or more second water coolers comprise one or more after-coolers positioned downstream of a second refrigerant compressor stage to receive and cool a compressed second refrigerant stream discharged by the second refrigerant compressor stage, wherein the second refrigerant compressor stage comprises a first sequential stage of compression and a second sequential stage of compression one or more inter-coolers being in fluid communication with the second compressor stage to receive a partially compressed second refrigerant stream from the first sequential stage of compression and pass an intercooled second refrigerant stream to the second sequential stage of compression for further compression, wherein the first selection comprises the at least one pre-cooler of the gas treatment stage, the one or more sub-coolers of the one or more first water coolers, and the one or more after-coolers of the one or more second water coolers, and wherein the second selection comprises the one or more condensers of the one or more first water coolers and the one or more inter-coolers of the one or more second water coolers.

8. The system according to claim 7, wherein the first selection further comprises the one or more inter-coolers.

9. The system according to claim 7, wherein the first selection further comprises the one or more condensers.

10. The method for treating and cooling a hydrocarbon stream comprising:

receiving the hydrocarbon stream, treating the hydrocarbon stream to generate a treated hydrocarbon stream, wherein treating comprises pre-cooling the hydrocarbon feed stream in a pre-cooler, cooling the treated hydrocarbon stream against a first refrigerant to generate a cooled hydrocarbon stream, wherein the first refrigerant is cooled in one or more first water coolers, further cooling at least part of the cooled hydrocarbon stream against a second refrigerant to generate a further cooled hydrocarbon stream, wherein the second refrigerant is cooled in one or more second water coolers, wherein the method further comprises receiving a stream of unchilled cooling water comprising a first part and a second part, passing the first part of the stream of unchilled cooling water to a chilling unit to obtain a stream of chilled cooling water, passing the stream of chilled cooling water to a first selection of the at least one pre-cooler, the one or more first water coolers and the one or more second water coolers to cool the respective hydrocarbon feed, first refrigerant, or second refrigerant, and passing the second part of the stream of unchilled cooling water to a second selection of the at least one pre-cooler, the one or more first water coolers and the one or more second water coolers to cool at least part of the respective hydrocarbon feed, the first refrigerant, the second refrigerant wherein the at least one pre-cooler, the one or more first water coolers, and the one or more second water coolers in the second selection are not in the first selection.

11. The method according to claim 10, comprising:

obtaining an indication of the temperature of the stream of chilled cooling water, controlling a working duty of the chilling unit to chill the first part of the stream of unchilled cooling water towards but not below a predetermined temperature.

12. The method according to claim 10, wherein the one or more first water coolers comprise one or more condensers positioned downstream of a first refrigerant compressor stage to receive and cool a compressed first refrigerant stream discharged by the first refrigerant compressor stage, and one or more sub-coolers positioned downstream of the one or more condensers to receive and cool at least part of the first refrigerant stream discharged by the one or more condensers, wherein the one or more second water coolers comprise one or more after-coolers positioned downstream of a second refrigerant compressor stage to receive and cool a compressed second refrigerant stream discharged by the second refrigerant compressor stage, wherein the second refrigerant compressor stage comprises a first sequential stage of compression and a second sequential stage of compression one or more inter-coolers being in fluid communication with the second compressor stage to receive a partially compressed second refrigerant stream from the first sequential stage of compression and pass an intercooled second refrigerant stream to the second sequential stage of compression for further compression, wherein the first selection comprises the at least one pre-cooler of the gas treatment stage, the one or more sub-coolers of the one or more first water coolers, and the one or more after-coolers of the one or more second water coolers, and wherein the second selection comprises the one or more condensers of the one or more first water coolers and the one or more inter-coolers of the one or more second water coolers.

13. The method according to claim 12, wherein the first selection further comprises the one or more inter-coolers.

14. The method according to claim 12, wherein the first selection further comprises the one or more condenser.

15. The system according to claim 1, wherein the system is arranged to cool at least 13% of the stream of unchilled cooling water.

16. The system according to claim 1, wherein the system is arranged to cool at least 22% of the stream of unchilled cooling water.

17. The method according to claim 10, wherein at least 13% of the stream of unchilled cooling water is chilled.

18. The method according to claim 10, wherein at least 22% of the stream of unchilled cooling water is chilled.

* * * * *